US005762545A

United States Patent [19]

Edwards

[11] Patent Number: 5,762,545

[45] Date of Patent: Jun. 9, 1998

[54] SANDING DISK WITH EXTENDED BLADES

[76] Inventor: Kerri O. Edwards, 1422 Laurene St., Fairbanks, Ak. 99701

[21] Appl. No.: 797,010

[22] Filed: Feb. 7, 1997

[51] Int. Cl.[6] ..... B24B 23/02

[52] U.S. Cl. ..... 451/359; 451/353; 451/461; 451/527; 451/548

[58] Field of Search ..... 451/69, 70, 353, 451/359, 527, 548, 461

[56] References Cited

U.S. PATENT DOCUMENTS

| | | | |
|---|---|---|---|
| 1,141,287 | 6/1915 | Thayer | 451/353 |
| 1,654,275 | 12/1927 | Strand | 451/359 X |
| 1,932,319 | 10/1933 | Myers | 451/353 |
| 2,793,476 | 5/1957 | Lombardo | 451/353 |
| 5,070,656 | 12/1991 | Brogden | 451/353 |
| 5,125,192 | 6/1992 | Welsch | 451/359 X |
| 5,403,231 | 4/1995 | Duckworth | 451/359 X |
| 5,567,503 | 10/1996 | Sexton et al. | 451/359 X |

FOREIGN PATENT DOCUMENTS

| | | | |
|---|---|---|---|
| 62-259759 | 11/1987 | Japan | 451/359 |

*Primary Examiner*—Timothy V. Eley
*Attorney, Agent, or Firm*—Michael J. Tavella

[57] ABSTRACT

A sanding disk for use with power tools. The disk has four arms that form a cross-shaped structure about a central disk. Alternatively, four arms can be attached to a set of braces to form a cross-shaped structure with no central hub. The device is designed to fit in a standard drill chuck, much like a standard disk sander. To make the device sufficiently light weight, the face of the sander has a number of holes drilled in the face of the device. In addition, the arms are made of relatively thin stock. Support braces are attached to the back of the arms to ensure that the arms do not warp or bend during the sanding operation. Four rectangular sanding pads are attached to the face of the device. These sheets do the actual sanding. These sheets are commercially available. The device is bolted onto a standard sanding disk plate. The disk plate is then inserted in a standard drill.

14 Claims, 9 Drawing Sheets

SANDING DISK WITH EXTENDED BLADES

TITLE OF THE INVENTION

Sanding Disk With Extended Blades

This invention relates to sanding disks and particularly to sanding disks with extended blades.

BACKGROUND OF THE INVENTION

Numerous types of wall board materials now exist. The standard sheet rock, or Gypsum board, has been followed by other materials such as Expanded Poly-Styrofoam or EPS sheets. The EPS sheets are lightweight and act as insulation.

Although many materials can be used, and the installation practices may vary, all wall treatments must be prepared for finishing. The most problematic of the preparation steps is sanding. There are two ways to sand a wall: using non-power sanders (a technique called hand sanding) or by using power tools. Several power tools have been invented to assist in the sanding job. The idea behind these techniques is to produce a uniform, smooth wall surface. Power tools are used to speed up the process to reduce labor costs.

Examples of hand sanding and power tools for sanding are found in the following U.S. Patents. U.S. Pat. No. 4,930,267 to Hill et al. discloses a rasp that uses rectangular sheets for sanding. The handle can be powered, if desired. U.S. Pat. No. 5,016,402 to Relter teaches a long, rectangular body that has handles to hold and push the sander. U.S. Pat. No. 5,390,449 to Hilton teaches a rotary type sander with a foam-backed disk. U.S. Pat. No. 3,747,285 to Block teaches a rotary sander that has a number of flexible fingers forming a web. Abrasive sheets are then attached to this web. Both of these devices are power driven. Finally, U.S. Pat. No. 5,464,366 to Hutchins discloses a reciprocating sander that has a rectangular sanding surface. Pistons cause the sanding pad to reciprocate, thereby assisting in the sanding process. The Hutchins tool is in common use today. The problem with the Hutchins tool is that it has a relatively small sanding surface area that covers only a small area at a time. As a result, sanding time is increased. Also, the Hutchins device has a lot of vibration associated with its operation. Such vibration can cause stress injuries in workers.

The other reciprocating sanders have solid sanding surfaces (large flat disks) that make inspection of the job difficult. Moreover, the large disks do not readily move out the dust particles formed by the sanding operation. These particles build up under the disks, reducing the sanding efficiency of the disks, as well as possibly causing uneven surfaces.

BRIEF SUMMARY OF THE INVENTION

The present invention overcomes all these problems. It has four arms that form a cross-shaped structure about a central hub. The device is designed to fit in a standard drill chuck, much like a standard disk sander. The face of the sander has a number of holes drilled in it to reduce its weight. In addition, the arms are made of relatively thin stock. Support braces are attached to the back of the arms to keep the arms from warping or bending during the sanding operation. Four rectangular sanding pads are attached to the face of the device. These sheets do the actual sanding. These sheets are commercially available and may be either held in place with adhesives or nuts and bolts. To use the device, the device is bolted onto a standard sanding disk plate. The disk plate is then inserted in a standard drill, where it is ready for use.

The device has an overall length of about three feet. This length ensures rapid sanding without being awkward or difficult to handle. Because the device has large gaps between the arms, dust produced by the sander can escape, reducing the potential for uneven sanding. Moreover, the gaps between the arms allow for a quick inspection capability that is not available using standard sanders.

DETAILED DESCRIPTION OF THE INVENTION

Figure 1:
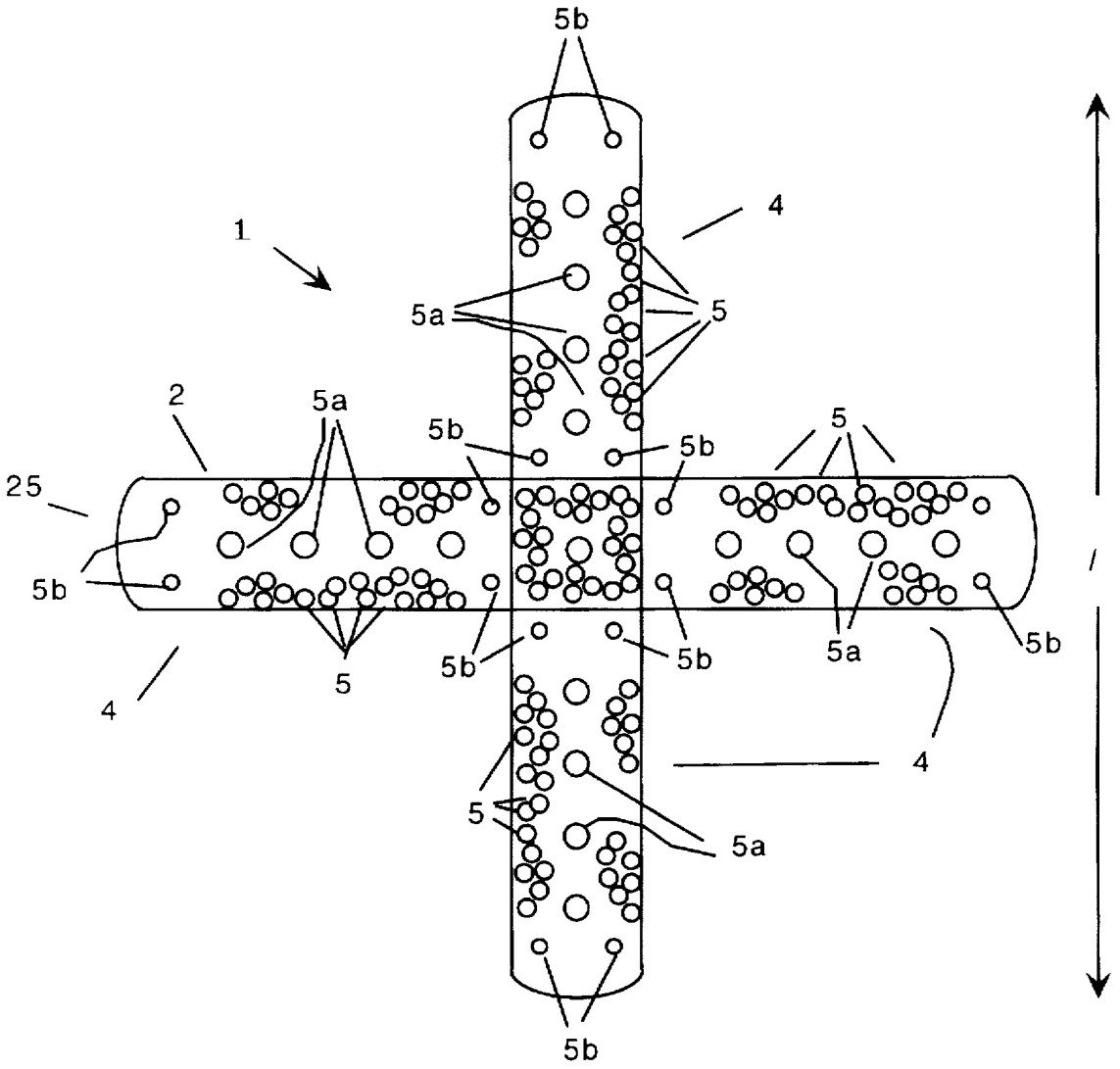
FIG. 1 is a front view of the invention with no sanding pads, bracing or the round mounting plate in place.

Referring now to FIG. 1, the front face 2 of the invention 1 is shown. As shown, the device 1 has a center hub 3 and four arms 4 as shown. In the preferred embodiment, the device has an overall length of three feet 1 inch as shown. The preferred embodiment is made from 3/16 inch aluminum stock. This size stock gives the lightest weight and optimum strength for the operation. This thickness also ensures that the mounting holes have enough depth to properly hold the hardware components that are attached to the device.

To reduce the weight even more, a number of holes 5 are drilled throughout the surface of the device 1 as shown. The holes 5 shown in the illustration cover the entire surface of the face 2, except where the mounting holes (discussed below) are located. The drawings show a partial pattern of holes 5 for clarity.

FIG. 1 also shows a number of mounting holes **5*a*. The holes 5*a* are for mounting a set of braces 10 to strengthen the arms 4. The braces 10 are discussed in greater detail below. A second set of mounting holes 5*b* is also shown. The holes 5*b* are for mounting removable sanding pads 6*a*. These pads are discussed further below. Both the mounting holes 5*a* and 5*b* are countersunk to receive the screw heads. This leaves the front face 2** of the arms flat and smooth.

Figure 2:
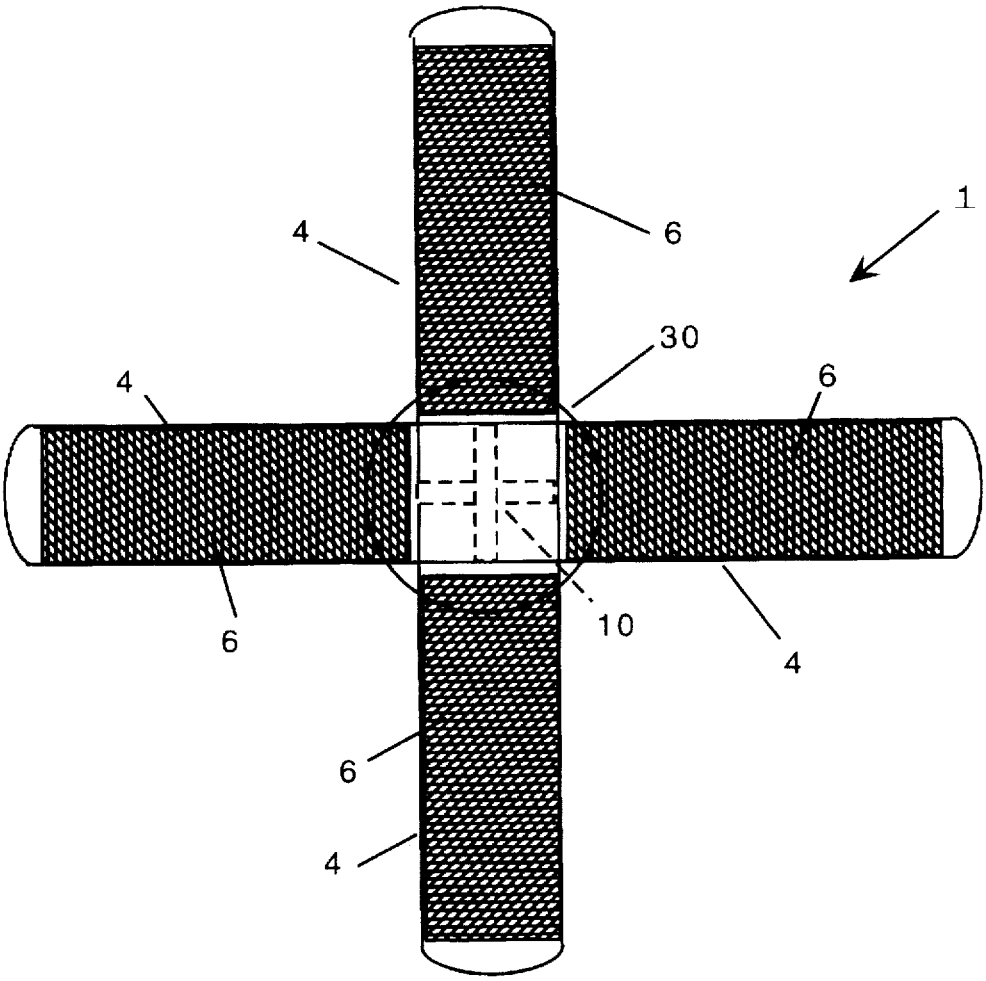
FIG. 2 is a front view of the invention with four standard sanding pads in place.

FIG. 2 shows the front surface of the sander with four sanding pads 6 in place. These pads 6 are standard adhesive type sanding pads that are commercially available. The abrasive grit rating for these pads depends on the particular application. Grits of between 12 and 24 can readily be used. The pads 6 are stuck to the face of the device 1 in an ordinary manner.

Alternatively, removable bolt on pads 6a (see FIG. 11) may also be used. These pads use screws that are fitted into the holes 5b (see, e.g., FIGS. 1, 3, and 11). Other than being held on the arms 4 by screws, there is no difference between the adhesive sanding pads 6 and the removable pads 6a.

Figure 3:
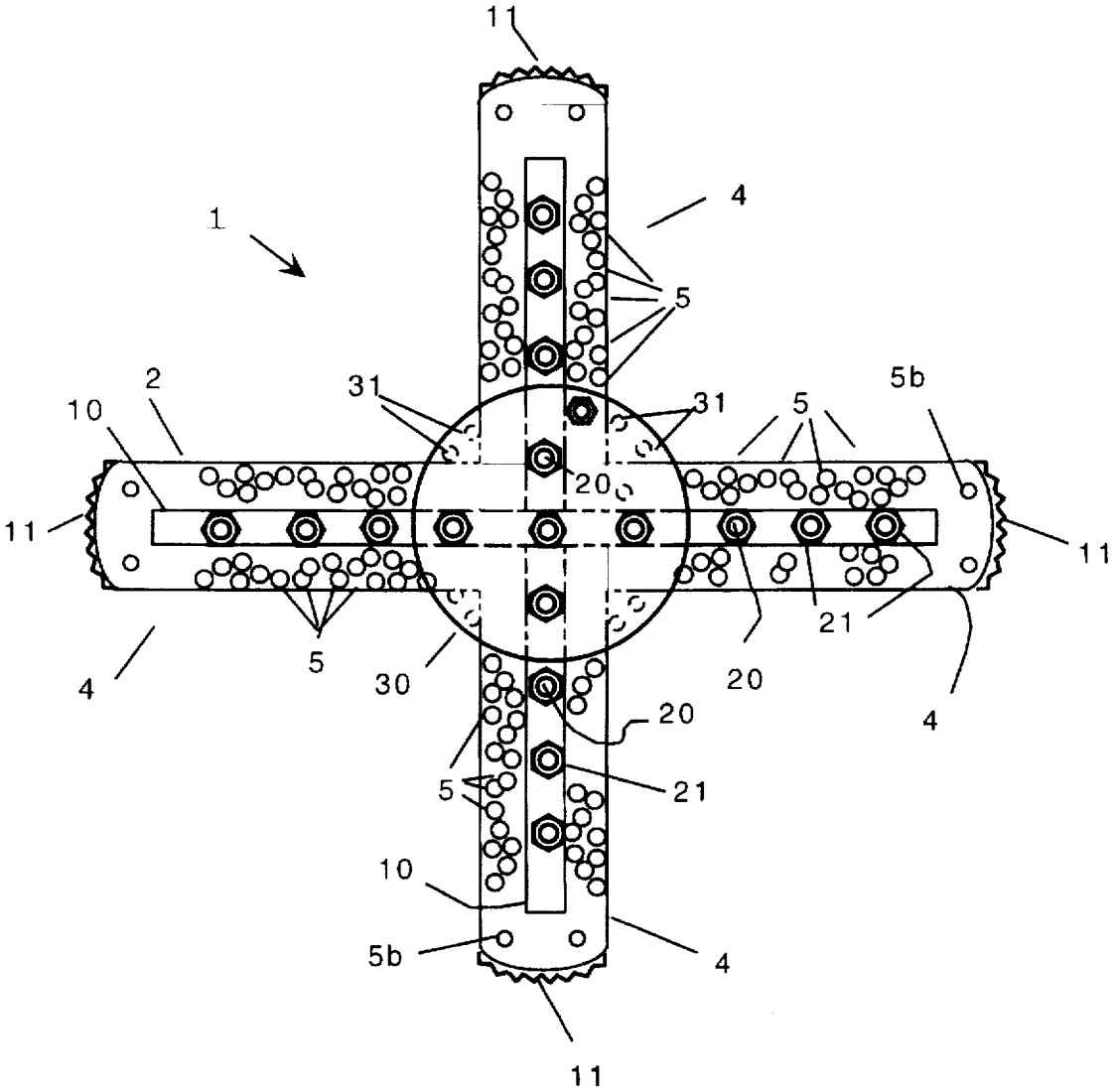
FIG. 3 is a rear view of the invention, showing the stiffener bars and the mounting plate, and a sawtooth edge on the ends of the arms.

FIG. 3 shows the back of the device 1. As discussed above, the preferred embodiment uses 3/16 inch aluminum plate for the arms 4. Although this gives the best weight for the device, its thickness is such that it readily flexes and bends. This is not preferred because it causes poor sanding contact, excessive vibration and may cause a blade to break under use. To strengthen the device, braces 10 are added to the back of the blades as shown. The braces 10 are made of square tubing that is bolted to the arms 4 as shown, using standard fasteners. In the preferred embodiment, the fasteners are flathead screws 20 and nuts 21 (see FIG. 5). The flat head screws 20 are countersunk into the face 2 of the device 1 to keep the sanding surface flat. At the center of the arms 4, the tubing is joined and welded (see FIG. 8). The five nuts 21 and screws 20 shown at the center are also used to attach a mounting plate 30 to the braces 10. The mounting plate 30 is discussed in greater detail below.

Figure 4:
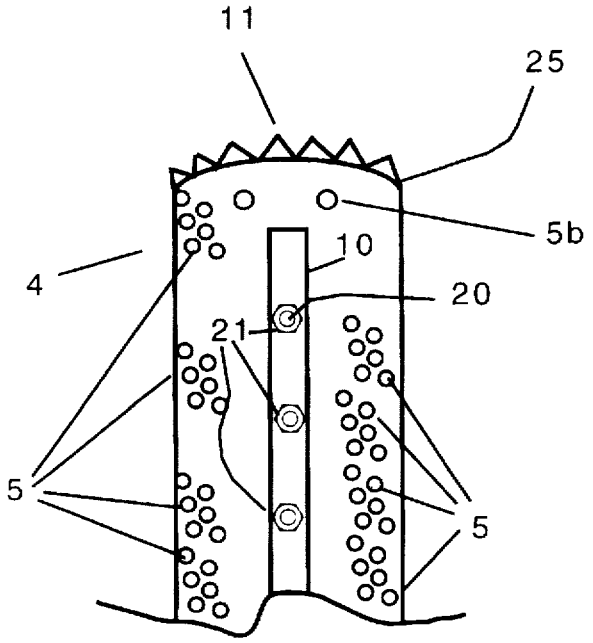
FIG. 4 is an enlarged detail view of one arm of the device showing the sawtooth edge.

FIGS. 3 and 4 show a saw tooth edge 11. FIG. 4 shows an enlarged detail of the distal ends (or tips) 25 of the arms 4. In the preferred embodiment, each of the arms 4 has a saw tooth edge 11 as shown. This edge 11 is preferred, but is no required and may be omitted. The sawtooth edge 11 is used to trim outside corners. Sometimes, the boards were cut too long and the end of an EPS board may stick out between ¼ to ⅜ of an inch. The saw tooth edge 11 is used to quickly trim the excess from these corners, leaving as smooth, flush corner.

Figure 5:
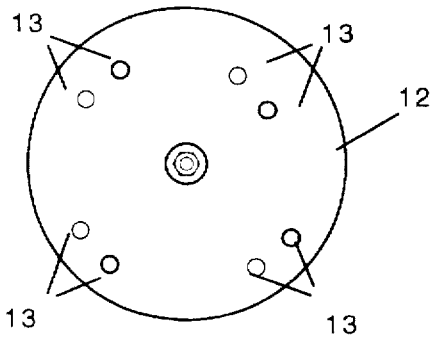
FIG. 5 is a front view of a rubber mounting disk for mounting the device to a drill.

FIGS. 5–10 show the mounting details for the device 1. Here, a disk plate 12 is bolted to the rear of the sander using bolts 16. As before, the heads of the fasteners are countersunk to lie flush with the face 2 of the device. FIG. 5 shows the face of a rubber mounting disk 12. The face of the rubber mounting disk 12 has a set of mounting holes 13 that align with a set of corresponding holes 31 in the mounting plate 30 (see FIG. 7). The rubber mounting pad is preferred because it acts as a shock absorber that reduces vibration, which can cause repetitive stress injury to workers.

Figure 6:
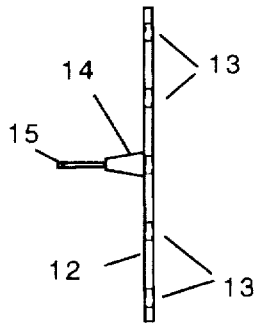
FIG. 6 is a side view of the rubber mounting disk showing the drill mounting member.
Figure 12:
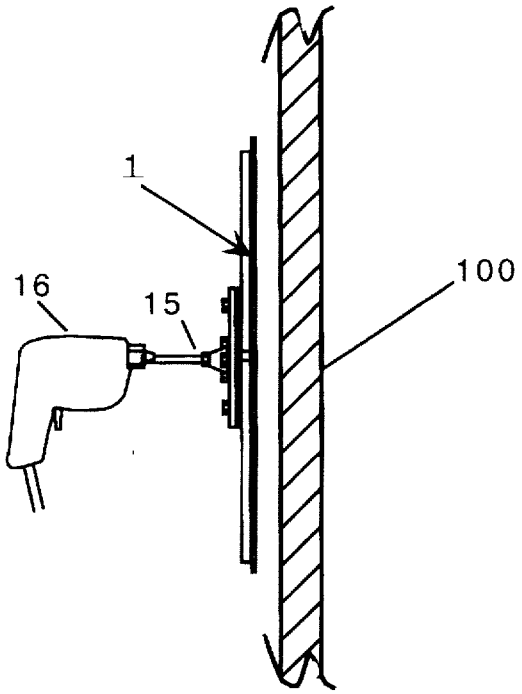
FIG. 12 is a detail view of the invention installed in a drill, ready to sand a wall surface.

FIG. 6 is a side view of the rubber mounting disk 12. A the back of the disk 12 is a fitting 14 and a shaft 15 that fits into a standard drill 16. FIG. 12 shows the device 1 in a standard drill 16, positioned in front of a workpiece 100.

Figure 7:
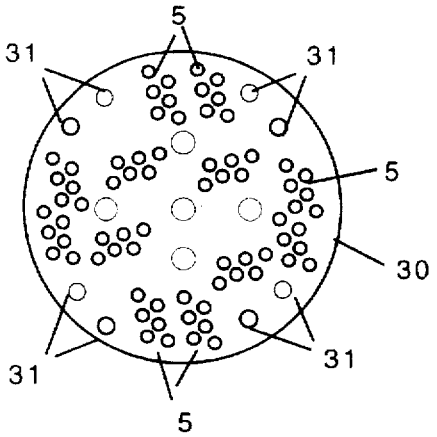
FIG. 7 is a front view of the mounting disk showing the mounting hole pattern.

FIG. 7 is a front view of the mounting plate 30. The mounting plate 30 is also made of thin aluminum plate. As discussed above, mounting holes 31 are positioned to align with the holes 13 on the rubber mounting disk 12. The holes are placed offset as shown so that they are not covered by the braces 10. Mounting holes 32 are provided to attach the mounting plate 30 to the braces 10, as discussed above. As with the arms 4, a number of holes 5 are drilled in the mounting plate 30 to reduce further the weight of the plate 30.

Figure 8:
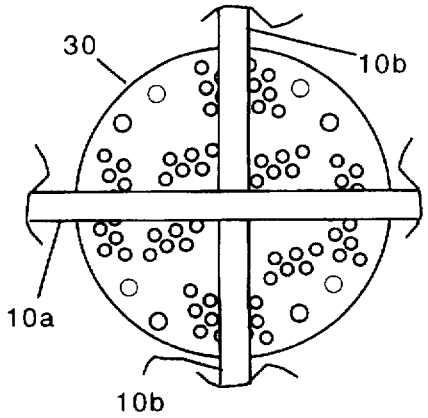
FIG. 8 is a detail view of the mounting plate with the stiffener bars in place, showing the offset mounting hole pattern for the rubber mounting disk.

FIG. 8 shows the braces 10 aligned on the mounting plate 30. The braces 10 can be made of four lengths of square tubing that are welded in the center, or can be made of one long piece 10a and two shorter pieces 10b as shown in the drawing. In the latter case, the two short pieces 10b are welded to the long piece 10a as shown. FIG. 8 also shows how the mounting holes 31 are offset from the braces 10. This gives space to attached the rubber mounting disk 12 to the mounting plate 30.

Figure 9:
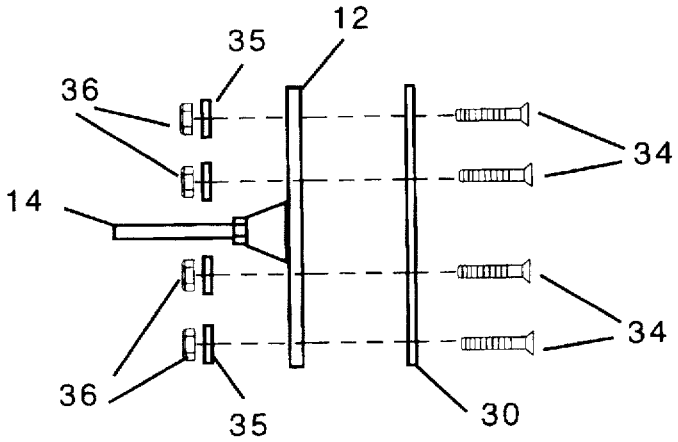
FIG. 9 is an exploded detail view of the mounting plate being attached to the rubber mounting disk.

FIG. 9 shows the mounting plate 30 being attached to the rubber mounting disk 12. Here, screws 34, washers 35 and nuts 36 are used as fasteners.

Figure 10:
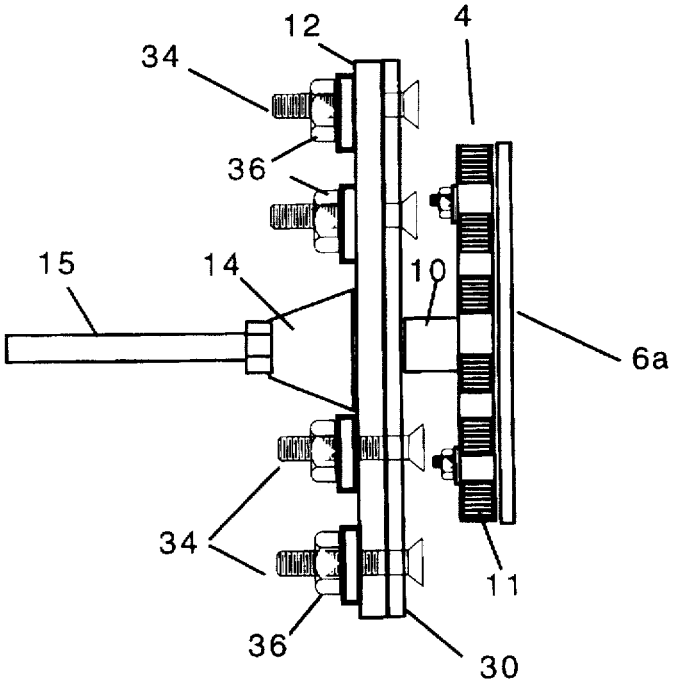
FIG. 10 is a top view of the device fully assembled.

FIG. 10 shows the device as fully assembled. The sanding pad 6a, the arm 4 (showing the saw tooth end 11), the brace 10, the mounting plate 30, and the rubber mounting disk 12 are shown.

Figure 11:
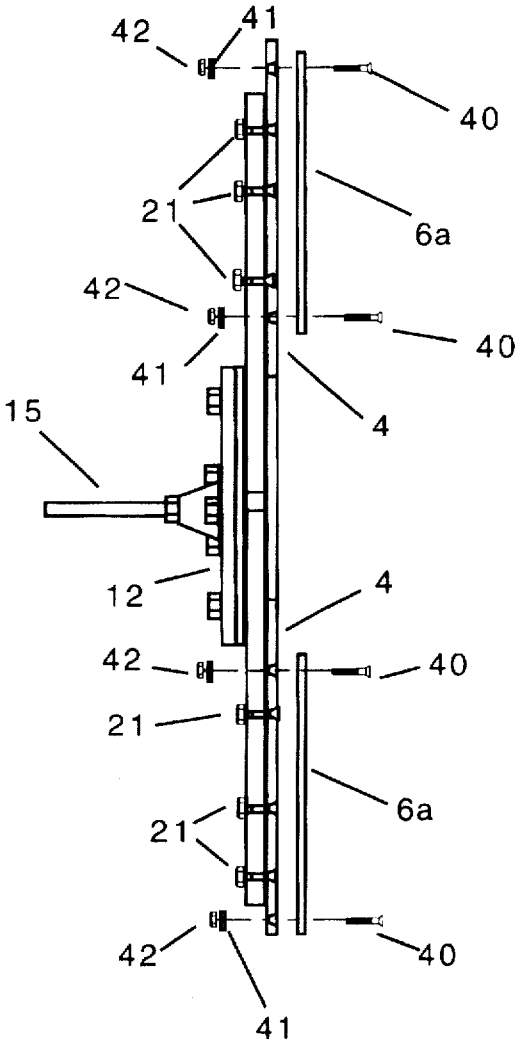
FIG. 11 is a partially exploded detail view of removable sanding pads being installed on the device.

FIG. 11 shows the removable sanding pads 6a being mounted on the arms 4 using screws 40, lock washers 41 and nuts 42 as shown.

FIG. 12 shows the device 1 attached to a standard drill 16. In practice, the device 1 is first applied to the workpiece 100 for sanding, and then the drill 16 is started.

Figure 13:
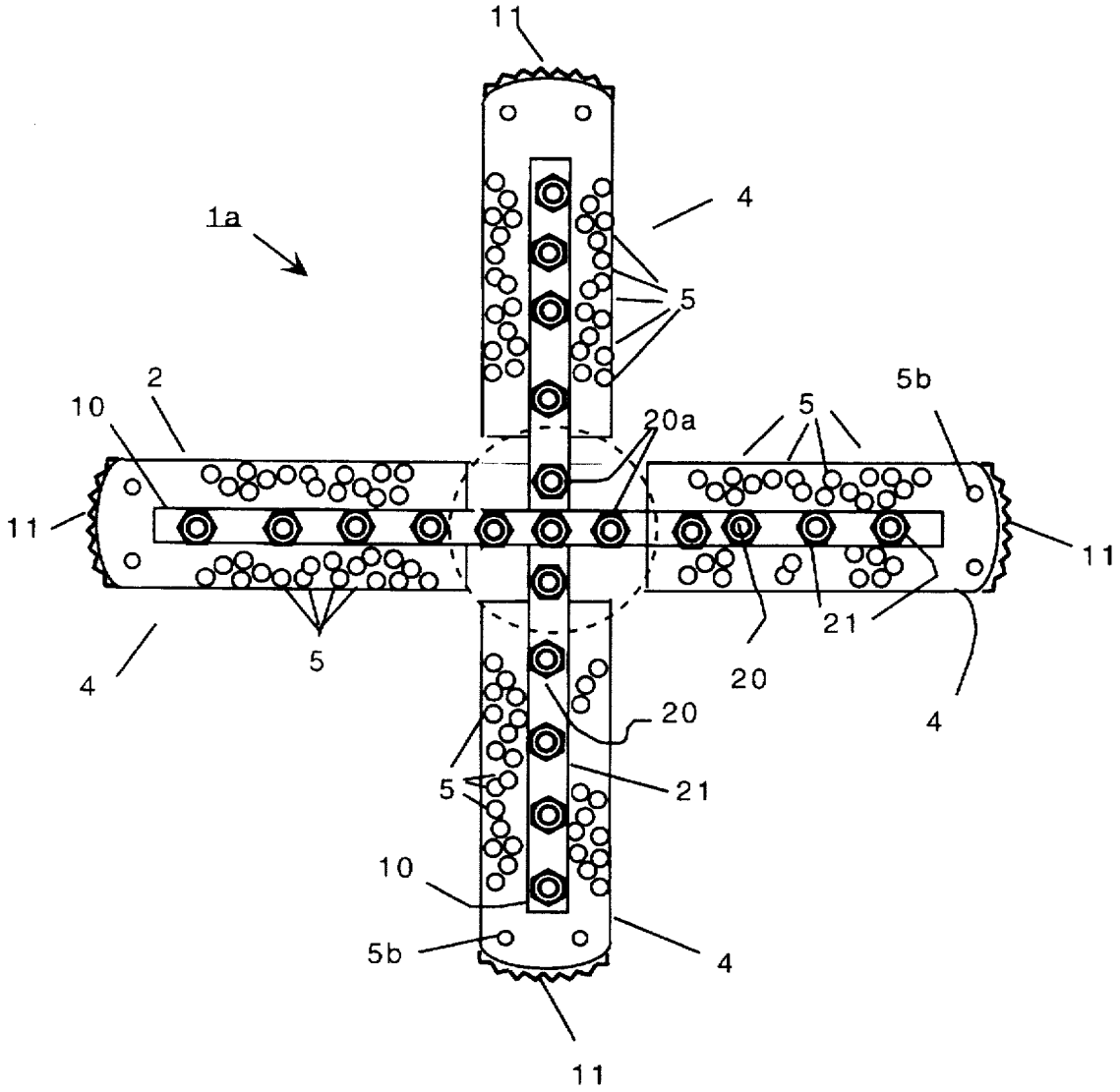
FIG. 13 is a rear view of a second embodiment of the invention.

FIG. 13 is a rear view of a second embodiment 1a of the invention. In this embodiment, the central hub 3 (see FIG. 3) is eliminated. The four arms 4 are independent members. The braces 10 are used to form the cross-shaped design. The mounting plate 30 (shown in dashed line in this figure for clarity) is attached to the braces 10 as shown, using bolts 20a. All other aspects of the invention remain the same. The only difference is that the arms 4 are separate members and that the braces 10 are used to hold the structure together, instead of only reinforcing it in as in the first embodiment 1.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A sander for sanding materials comprising:

a) a support member having a central hub and a plurality of arms, extending outwardly therefrom, said plurality of arms each having a distal end spaced apart from said central hub, said plurality of arms each further having a sawtooth edge at said distal end;

b) a plurality of sanding sheets, removably attached to the plurality of arms; and c) a means for removably attaching said support member to a power drill motor.

2. The sander of claim 1 wherein the support member also has a plurality of holes formed therein.

3. The sander of claim 1 wherein the support member further comprises a plurality of support bars, fixedly attached to said plurality of arms.

4. The sander of claim 1 wherein the means for removably attaching said support member to a power drill motor comprise a mounting plate; and a plurality of fasteners for fastening said mounting plate to said support member.

5. The sander of claim 1 wherein the plurality of sanding sheets are attached using adhesive strips.

6. The sander of claim 1 wherein the plurality of sanding sheets are attached using screws and nuts.

7. A sander for sanding materials comprising:

a) a support member having a central hub and a plurality of arms, extending outwardly therefrom, said support member and central hub also having a plurality of holes formed therein;

b) a plurality of sanding sheets, removably attached to the plurality of arms;

c) a plurality of support bars, fixedly attached to said plurality of arms;

d) a rear mounting plate, being removably attached to said plurality of support bars; and e) a rubber mounting pad, removably attached to said rear mounting pad, said rubber mounting pad having a shaft, extending outwardly therefrom for placement into a power drill.

8. The sander of claim 7 wherein the plurality of arms each have a distal end, spaced apart from said central hub, each arm also having a sawtooth edge at said distal end.

9.The sander of claim 7 wherein the plurality of sanding sheets are attached using adhesive strips.

10.The sander of claim 7 wherein the plurality of sanding sheets are attached using screws and nuts.

11. The sander of claim 7 wherein the plurality of support bars are made of square tubing.

12. A sander for sanding materials comprising:

a) a plurality of arms, said plurality of arms having a plurality of holes formed therein, each arm having a distal end and a proximate end, each arm also having a sawtooth edge at said distal end;

b) a plurality of sanding sheets, removably attached to the plurality of arms;

c) a plurality of support bars, attached to said plurality of arms, said plurality of support bars including lengths of square tubing, having a plurality of mounting holes formed therein, whereby said plurality of support bars forms a cross-shaped configuration, such that the distal ends of said plurality of arms form outer points of the cross-shaped configuration;

d) a means for removably attaching said lengths of square tubing to said plurality of arms;

e) a rear mounting plate, being removably attached to said plurality of support bars, said rear mounting plate having a plurality of holes formed therein; and f) a rubber mounting pad, removably attached to said rear mounting pad, said rubber mounting pad having a shaft, extending outwardly therefrom for placement into a power drill.

13. The sander of claim 12 wherein the plurality of sanding sheets are attached using adhesive strips.

14. The sander of claim 12 wherein the plurality of sanding sheets are attached using screws and nuts.

* * * * *